US010840648B2

(12) United States Patent
Hashimoto et al.

(10) Patent No.: US 10,840,648 B2
(45) Date of Patent: Nov. 17, 2020

(54) SHIELD TERMINAL AND SHIELD CONNECTOR

(71) Applicant: Sumitomo Wiring Systems, Ltd., Yokkaichi (JP)

(72) Inventors: Norihito Hashimoto, Yokkaichi (JP); Keisuke Kanemura, Yokkaichi (JP); Motoki Kubota, Yokkaichi (JP); Liping Kang, Yokkaichi (JP); Shohei Mitsui, Yokkaichi (JP); Wataru Yamanaka, Yokkaichi (JP); Masanobu Kasuga, Yokkaichi (JP); Ai Hirano, Yokkaichi (JP); Ryo Yamada, Toyota (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/802,724

(22) Filed: Feb. 27, 2020

(65) Prior Publication Data

US 2020/0274265 A1 Aug. 27, 2020

(30) Foreign Application Priority Data

Feb. 27, 2019 (JP) ..... 2019-033588

(51) Int. Cl.

| | |
|---|---|
| ***H01R 13/6583*** | (2011.01) |
| ***H01R 9/05*** | (2006.01) |
| ***H01R 13/6593*** | (2011.01) |
| ***H01R 13/58*** | (2006.01) |
| ***H01R 13/6582*** | (2011.01) |

(52) U.S. Cl.

CPC ..... *H01R 13/6583* (2013.01); *H01R 9/0524* (2013.01); *H01R 13/5812* (2013.01); *H01R 13/6582* (2013.01); *H01R 13/6593* (2013.01)

(58) Field of Classification Search

CPC ..... H01R 13/6583

See application file for complete search history.

(56) References Cited

U.S. PATENT DOCUMENTS

| | | | | |
|---|---|---|---|---|
| 4,995,836 | A * | 2/1991 | Toramoto | H01R 9/0518 439/578 |
| 10,734,762 | B2 * | 8/2020 | Kanemura | H01R 13/6582 |
| 2018/0115115 | A1 | 4/2018 | Nakashima | |

(Continued)

FOREIGN PATENT DOCUMENTS

| | | |
|---|---|---|
| JP | 2018-067496 | 4/2018 |

*Primary Examiner* — James Harvey

(74) *Attorney, Agent, or Firm* — Gerald E. Hespos; Michael J. Porco; Matthew T. Hespos

(57) ABSTRACT

A shield terminal (20) includes an inner conductor terminal (21) and an outer conductor terminal (30) surrounding the inner conductor terminal (21) and having a tubular fitting portion (400 to which a mating outer conductor (130) is fit. The tubular fitting portion (40) includes butting edges (41) to be butted against each other on both circumferential edge parts (41A, 41B), fixed contact point portions (42) formed to have an embossed shape in a butting-side half circumference portion (C1), the fixed contact point portions (42) contacting the mating outer conductor (130), and resilient contact portions (51) formed by cutting and raising parts of an opposite-side half circumference portion (C2) on a side opposite to the butting-side half circumference portion (C1), the resilient contact portions (51) resiliently contacting the mating outer conductor (130).

4 Claims, 13 Drawing Sheets

(56) References Cited

U.S. PATENT DOCUMENTS

| | | | | |
|---|---|---|---|---|
| 2019/0199008 | A1* | 6/2019 | Kanemura | H01R 13/50 |
| 2019/0199013 | A1* | 6/2019 | Kanemura | H01R 9/0518 |
| 2019/0199014 | A1* | 6/2019 | Kanemura | H01R 13/6583 |
| 2019/0199036 | A1* | 6/2019 | Kanemura | H01R 24/40 |
| 2020/0274262 | A1* | 8/2020 | Mitsui | H01R 24/38 |
| 2020/0274265 | A1* | 8/2020 | Hashimoto | H01R 13/5812 |

* cited by examiner

SHIELD TERMINAL AND SHIELD CONNECTOR

BACKGROUND

Field of the Invention

The invention relates to a shield terminal and a shield connector.

Related Art

A shield terminal disclosed in Japanese Unexamined Patent Publication No. 2018-67496 includes an inner conductor terminal, a dielectric for accommodating the inner conductor terminal and an outer conductor terminal surrounding the dielectric. The inner conductor terminal is fixed conductively to an inner conductor of a shielded cable. The dielectric is interposed between the inner conductor terminal and the outer conductor terminal. The outer conductor terminal includes a tubular fitting to be fit to a mating outer conductor terminal inserted inside. The tubular fitting portion is maintained in a hollow cylindrical shape with both circumferential ends butted against each other. The outer conductor terminal is formed with four resilient contacts along a circumferential direction. Each resilient contact has both front and rear ends in an axial direction integrally connected to the tubular fitting portion and supported on both ends. The outer conductor terminal is configured such that a return current generated when an electrical signal flows in the inner conductor terminal flows to the mating outer conductor terminal via the resilient contacts. Further, each resilient contact is formed between two elongated cutout portions (holes) along the axial direction.

In the shield terminal of Japanese Unexamined Patent Publication No. 2018-67496, two of the resilient contact portions are provided on a half circumference side where butting portions of circumferential edges are butted against each other in the tubular fitting. However, if the cutouts (holes) are near the butting portions in the tubular fitting, strength around the butting portions is reduced. Thus, the butting portions easily are separated and it may not be possible to maintain the tubular shape. In this way, it may not be possible to sufficiently ensure a shielding property for the inner conductor terminal by the outer conductor terminal.

The invention was completed on the basis of this situation and aims to provide a shield terminal and a shield connector capable of preventing the deterioration of a shielding property.

SUMMARY

The invention is directed to a shield terminal with an inner conductor terminal and an outer conductor terminal surrounding the inner conductor terminal. The outer conductor terminal includes a tubular fitting to which a mating outer conductor is fit. The tubular fitting includes butting edges to be butted against each other on circumferential edges. A fixed contact with an embossed shape is provided in a half circumference portion where the butting edges are located. The fixed contact contacts the mating outer conductor. A resilient contact is formed by cutting and raising a part of a half circumference portion on a side opposite to the butting-side half circumference portion. The resilient contact resiliently contacts the mating outer conductor.

The resilient and fixed contacts contact the mating outer conductor with the mating outer conductor fit in the tubular fitting. Thus, a return current generated in the outer conductor terminal when an electrical signal flows in the inner conductor terminal can be caused to flow to the mating outer conductor via the resilient contact and the fixed contact. In addition, the fixed contact has the embossed shape and can be formed without making a hole. Thus, as compared to a configuration in which a contact is formed with a hole by cutting and raising, a strength around the butting edges in the tubular fitting is not reduced. In this way, the circumferential edges of the tubular fitting will not separate due to a lack of strength and a shielding property for the inner conductor terminal by the outer conductor terminal does not deteriorate.

The tubular fitting may include two resilient contacts and two fixed contacts. According to this configuration, the outer conductor terminal is in contact with the mating outer conductor at four points. Thus, the number of flowing paths of the return current from the tubular fitting to the mating outer conductor increases and the shielding property can be improved as compared to a configuration in which one resilient contact and one fixed contact are provided.

The two fixed contacts may be formed respectively on opposite circumferential sides of the butting edges. The resilient contacts may be formed respectively at positions radially facing the fixed contacts in the tubular fitting. Accordingly, the resilient contacts and the fixed contact points can be arranged while being spaced large distances in the circumferential direction of the tubular fitting. Thus, the return current can flow efficiently from the outer conductor terminal to the mating outer conductor and the shielding property can be improved.

A shield connector may include the shield terminal having a dielectric interposed between the inner conductor terminal and the outer conductor, and a connector housing for accommodating the shield terminal. Accordingly, a good shielding property can be realized, and this shield connector is suitable for high-speed communication in an automotive vehicle.

DETAILED DESCRIPTION

An embodiment of the invention is described with reference to FIGS. 1 to 13. A shield connector 10 of this embodiment is installed in a vehicle and is used in high-speed communication between in-vehicle electrical components. Note that, in the following description of each connector, an end facing a mating connector to be connected is referred to as a front concerning a front-rear direction. For example, a left side of FIG. 2 is referred to as a front. Further, upper and lower sides are based on a vertical direction of FIGS. 1 and 10.

Figure 1:
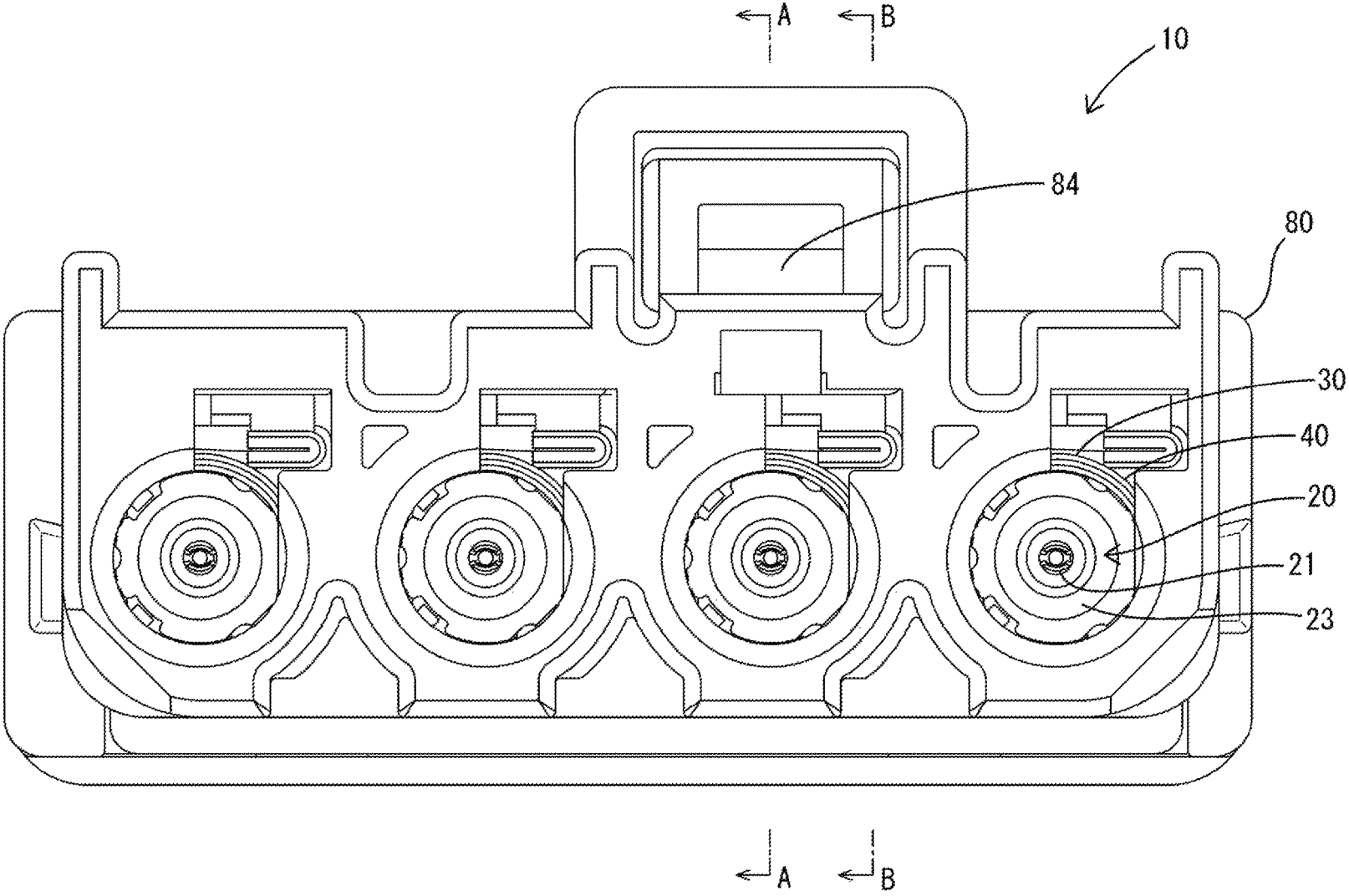
FIG. 1 is a front view of a shield connector of one embodiment of the present invention.
Figure 2:
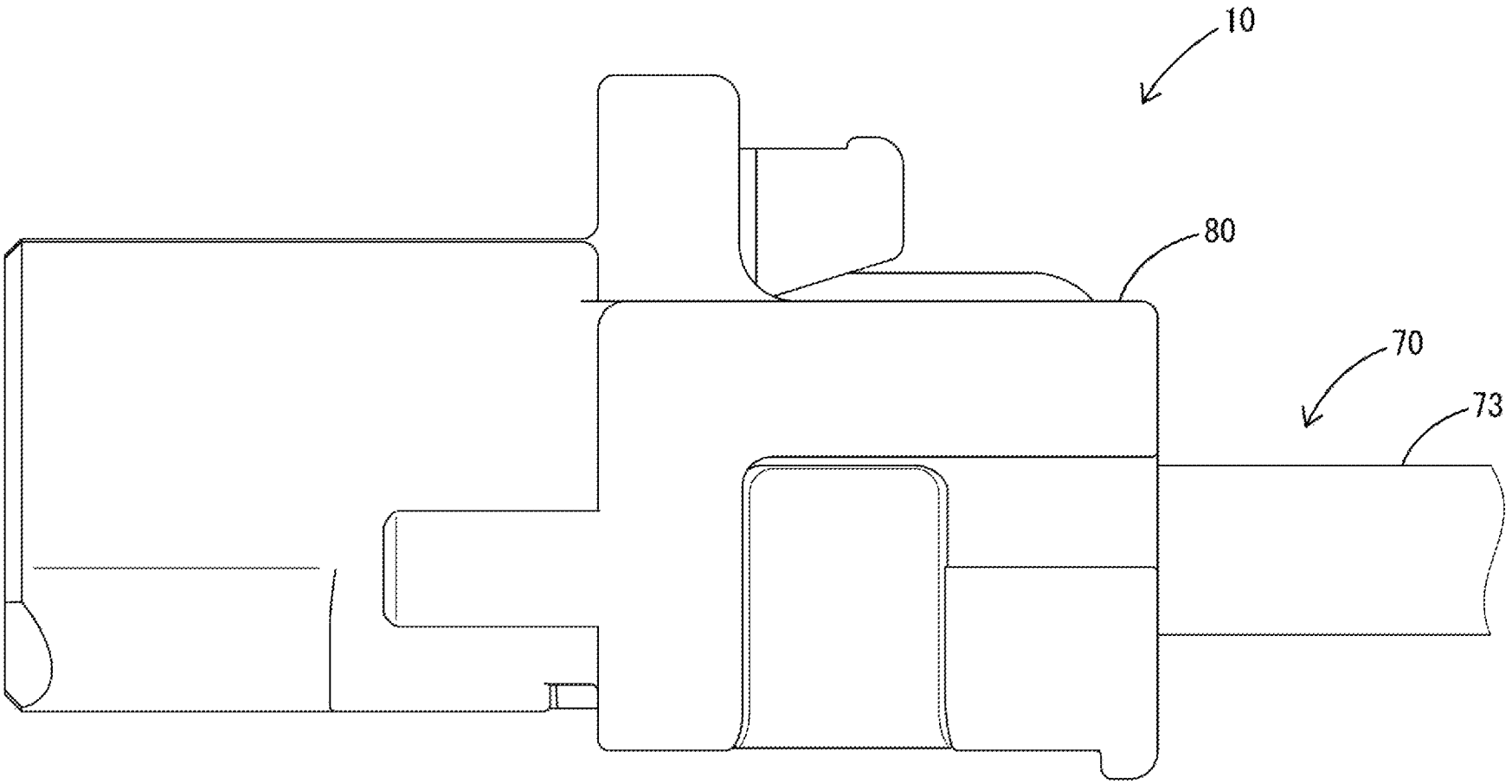
FIG. 2 is a side view of the shield connector.
Figure 3:
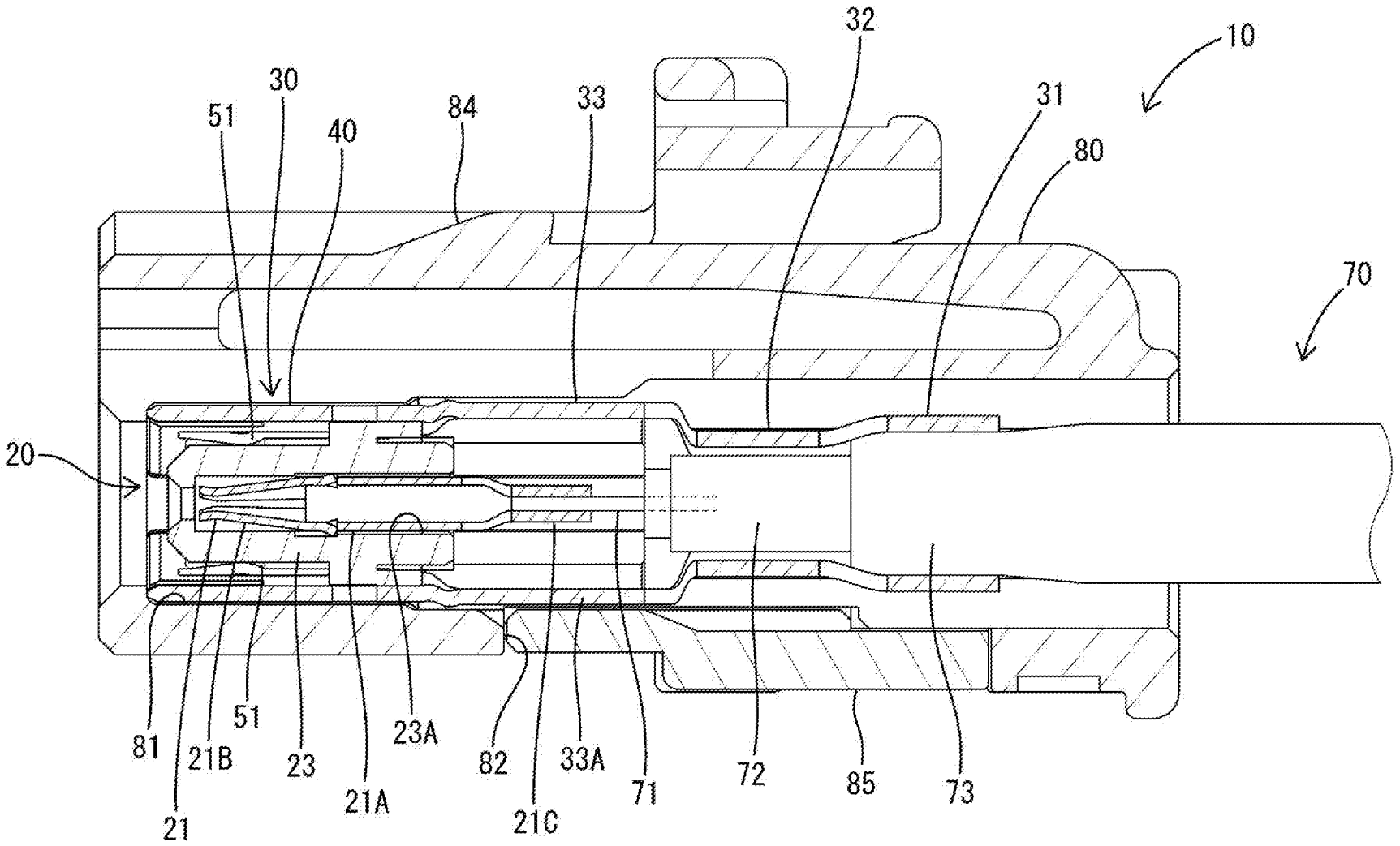
FIG. 3 is a section along A-A of FIG. 1.
Figure 4:
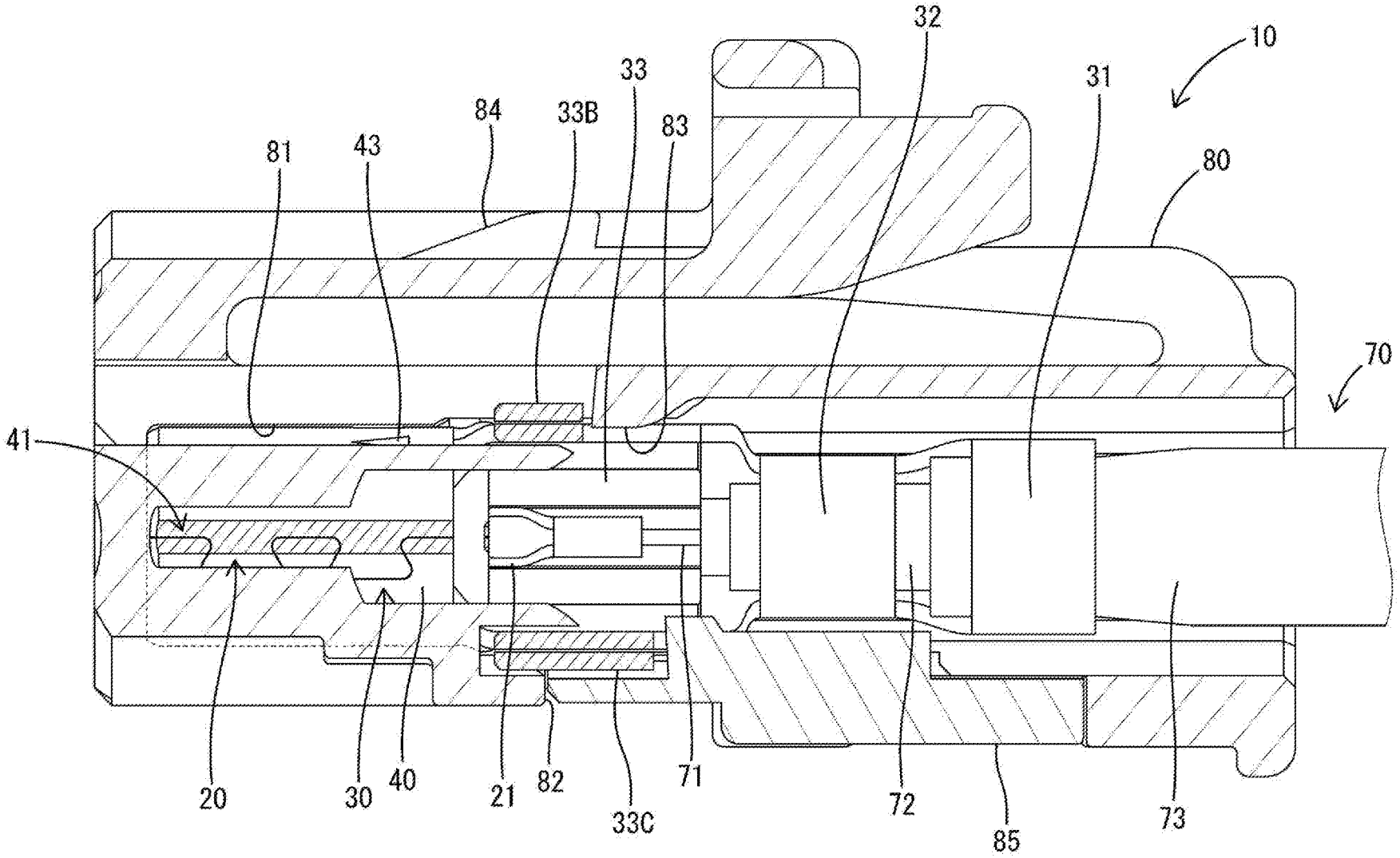
FIG. 4 is a section along B-B of FIG. 1.

As shown in FIGS. 1, 3 and 4, the shield connector 10 includes shield terminals 20 and a connector housing 80 for accommodating the shield terminals 20. The shield connector 10 is configured as a so-called female connector and is connected to a mating connector 110 configured as a male connector. The shield terminal 20 includes an inner conductor terminal 21, an outer conductor terminal 30 surrounding the inner conductor terminal 21 and a dielectric 23 interposed between the outer conductor terminal 30 and the inner conductor terminal 21.

As shown in FIG. 3, the inner conductor terminal 21 is formed, such as by bending a conductive metal plate. As shown in FIG. 4, the inner conductor terminal 21 has a substantially tubular shape elongated in the front-rear direction and is fixed conductively to an inner conductor 71 of a shielded cable 70. The inner conductor terminal 21 includes an inner conductor body 21A, a resilient piece 21B projecting forward from the inner conductor body 21A and a conductor connecting portion 21C projecting rearward from the inner conductor body 21A.

The dielectric 23 is formed of an insulating synthetic resin having a predetermined dielectric constant and includes a terminal accommodation chamber 23A penetrating in the front-rear direction, as shown in FIG. 3. The inner conductor body 21A is accommodated into the terminal accommodation chamber 23A. The resilient piece 21B of the inner conductor terminal 21 projects forward from a front end opening of the terminal accommodation chamber 23A with the inner conductor body 21A held in the dielectric 23, and the conductor connecting portion 21C is exposed from a rear end opening of the terminal accommodation chamber 23A. The dielectric 23A maintains an insulated state between the inner conductor terminal 21 and the outer conductor terminal 30.

The connector housing 80 is a so-called female housing made of synthetic resin. Cavities 81 penetrate through the connector housing 80 in the front-rear direction and receive the shield terminals 20, as shown in FIG. 3. A retainer fitting groove 82 vertically penetrates through a bottom wall near a rear end of the connector housing 80. The retainer fitting groove 82 is formed below the cavities 81 and communicates with the cavities 81, as shown in FIGS. 3 and 4. The connector housing 80 is formed with deflectable locking lances 83 that project into the cavities 81 to retain and lock the shield terminals 20. A lock protrusion 84 is formed on an outer surface of the connector housing 80 above the cavities 81. The lock protrusion 84 is locked to a housing lock 183 of a mating housing 180 to hold the connector housing 80 and the mating housing 180 in a locked state.

The outer conductor terminal 30 is formed, such as by bending a single conductive metal plate and includes a first crimping portion 31, a second crimping portion 32, a link 33 and a tubular fitting 40, as shown in FIGS. 5 to 9. The outer conductor terminal 30 is mounted in the connector housing 80 in a horizontal posture turned 90° about an axis from a state of FIG. 5. Thus, in the following description of the outer conductor terminal 30, upper and lower sides are based on a vertical direction of FIG. 6. The first crimping portion 31 is at a rear part of the outer conductor terminal 30 and is an open barrel with two crimping pieces extending respectively on left and right sides. As shown in FIGS. 3 and 4, the first crimping portion 31 is fixed to the outer periphery of a sheath 73 of the shielded cable 70. The second crimping portion 32 is connected to a front part of the first crimping portion 31 and is an open barrel with two crimping pieces extending respectively on left and right sides. The second crimping portion 32 is fixed to a shield conductor 72 of the shielded cable 70. The link 33 includes left and right side plates 33A. Rear ends of the side plates 33A are connected respectively to the front ends of the crimping pieces of the second crimping portion 32, and front ends thereof are linked to left and right sides in a rear end of the tubular fitting 40. Extending pieces 33B, 33C folded in two are formed respectively on the upper ends of the left and right side plates 33A.

As shown in FIGS. 5 to 9, the tubular fitting 40 is a hollow cylinder with an axis extending in the front-rear direction, and is in a front part of the outer conductor terminal 30. The dielectric 23 is accommodated in the tubular fitting 40. A hollow cylindrical mating outer conductor 130 is fit into the tubular fitting 40 from the front. The mating outer conductor 130 is fit into a clearance between the outer periphery of the dielectric 23 and the inner periphery of the tubular fitting portion 40. The tubular fitting 40 is formed integrally with two resilient contacts 51 and two fixed contacts 42 capable of contacting the outer periphery of the mating outer conductor 130. The resilient contacts 51 resiliently contact the outer periphery of the mating outer conductor 130 so that the outer conductor terminal 30 and the mating outer conductor terminal 130 are connected conductively with a predetermined contact pressure.

Figure 5:
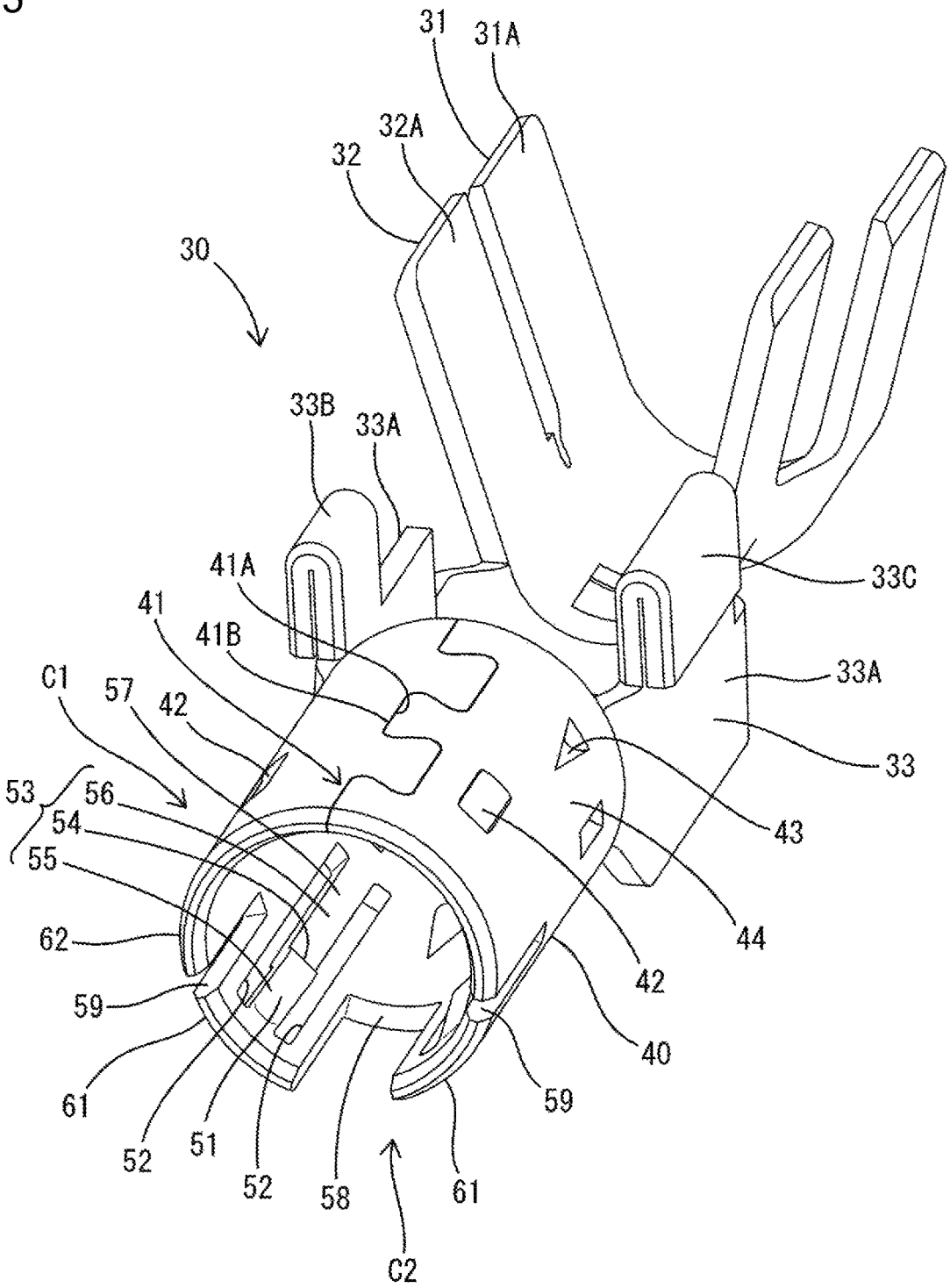
FIG. 5 is a perspective view of an outer conductor terminal.
Figure 6:
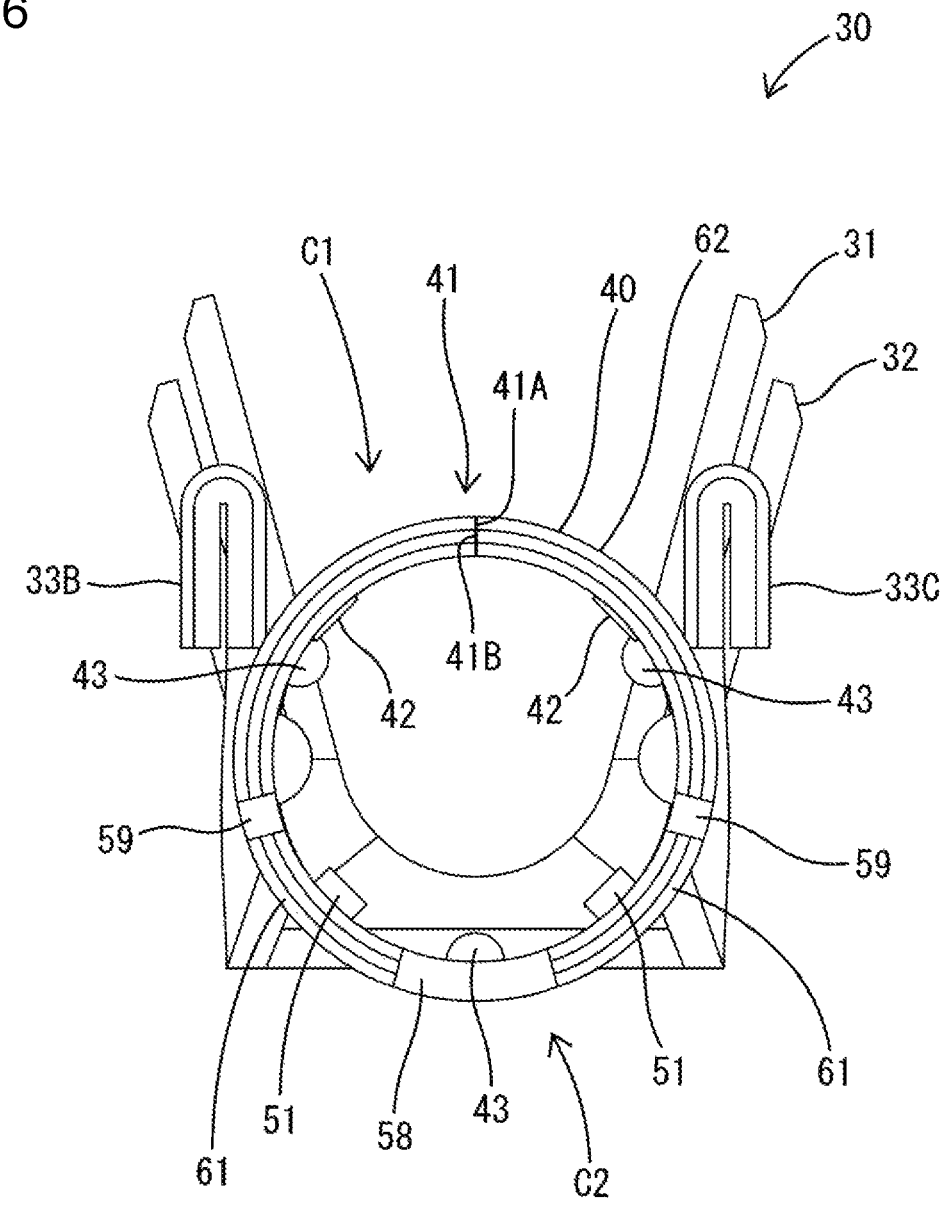
FIG. 6 is a front view of the outer conductor terminal.
Figure 8:
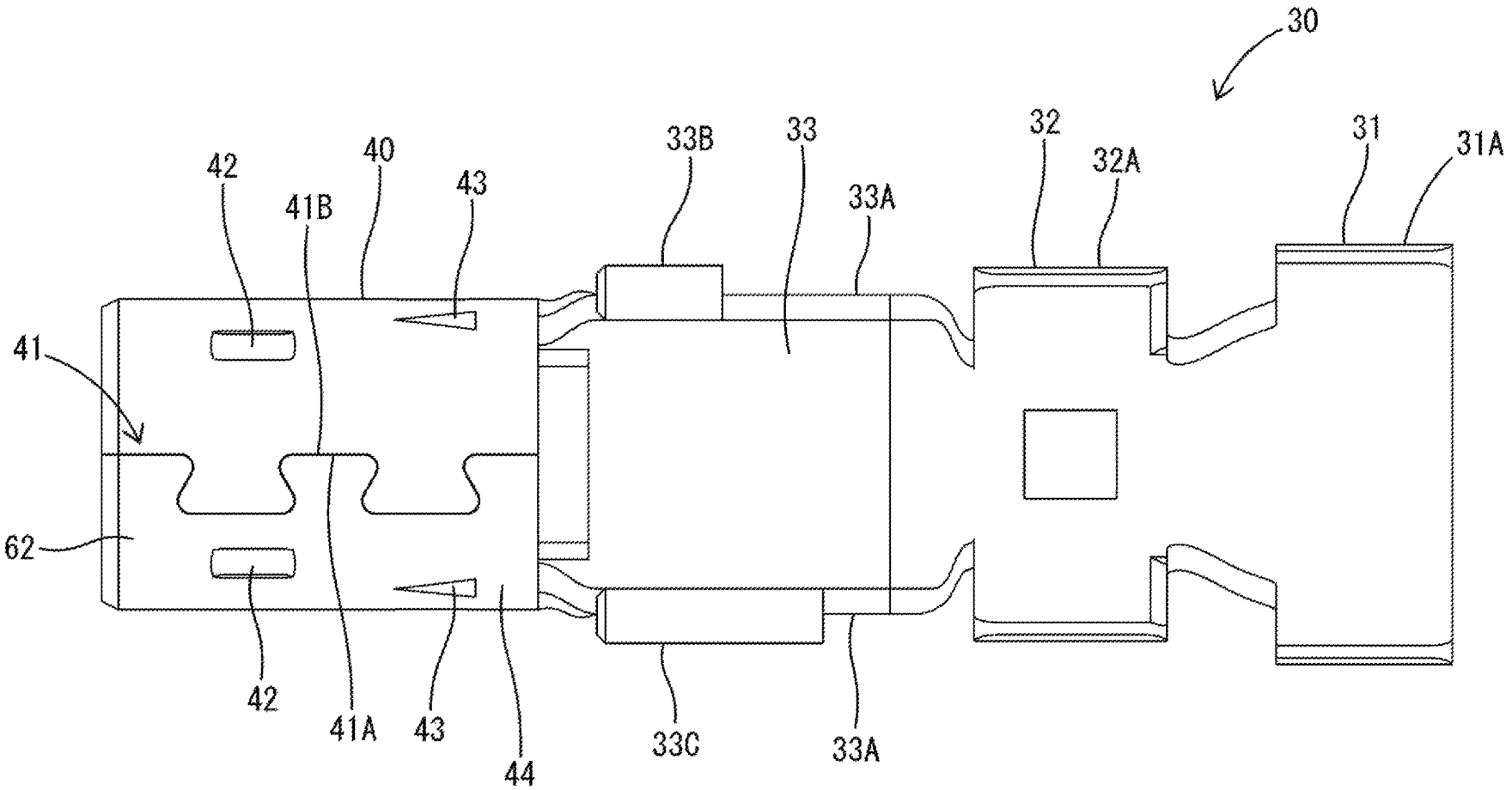
FIG. 8 is a plan view of the outer conductor terminal.

As shown in FIGS. 5 and 6, the tubular fitting 40 includes butting edges 41 in a lateral center of an upper end. The butting edges 41 are constituted by both circumferential edges 41A, 41B of the tubular fitting 40 to be butted against each other. As shown in FIGS. 5 and 8, the butting edges 41 have a convex-concave shape along the front-rear direction. The edges 41A, 41B are meshed with each other to maintain the tubular fitting 40 in the hollow cylindrical shape. A half circumference part where the butting edges 41 are located in the tubular fitting 40 (part above a vertical center (side U of FIG. 13)) is referred to as a butting-side half circumferential portion C1. Further, a half circumference part (part below the vertical center (side L of FIG. 13)) on a side opposite to the butting-side half circumferential portion C1 in the tubular fitting portion 40 is referred to as an opposite-side half circumferential portion C2.

As shown in FIGS. 5, 6 and 8, the fixed contacts 42 are disposed bilaterally symmetrically on both circumferential sides of the butting edges 42 in the butting-side half circumference portion C1. Further, the fixed contacts 42 are disposed near the front end of the tubular fitting 40 in the front-rear direction. The fixed contacts 42 have an embossed shape in the form of a rectangular flat base by being struck inward of the tubular fitting 40.

Figure 9:
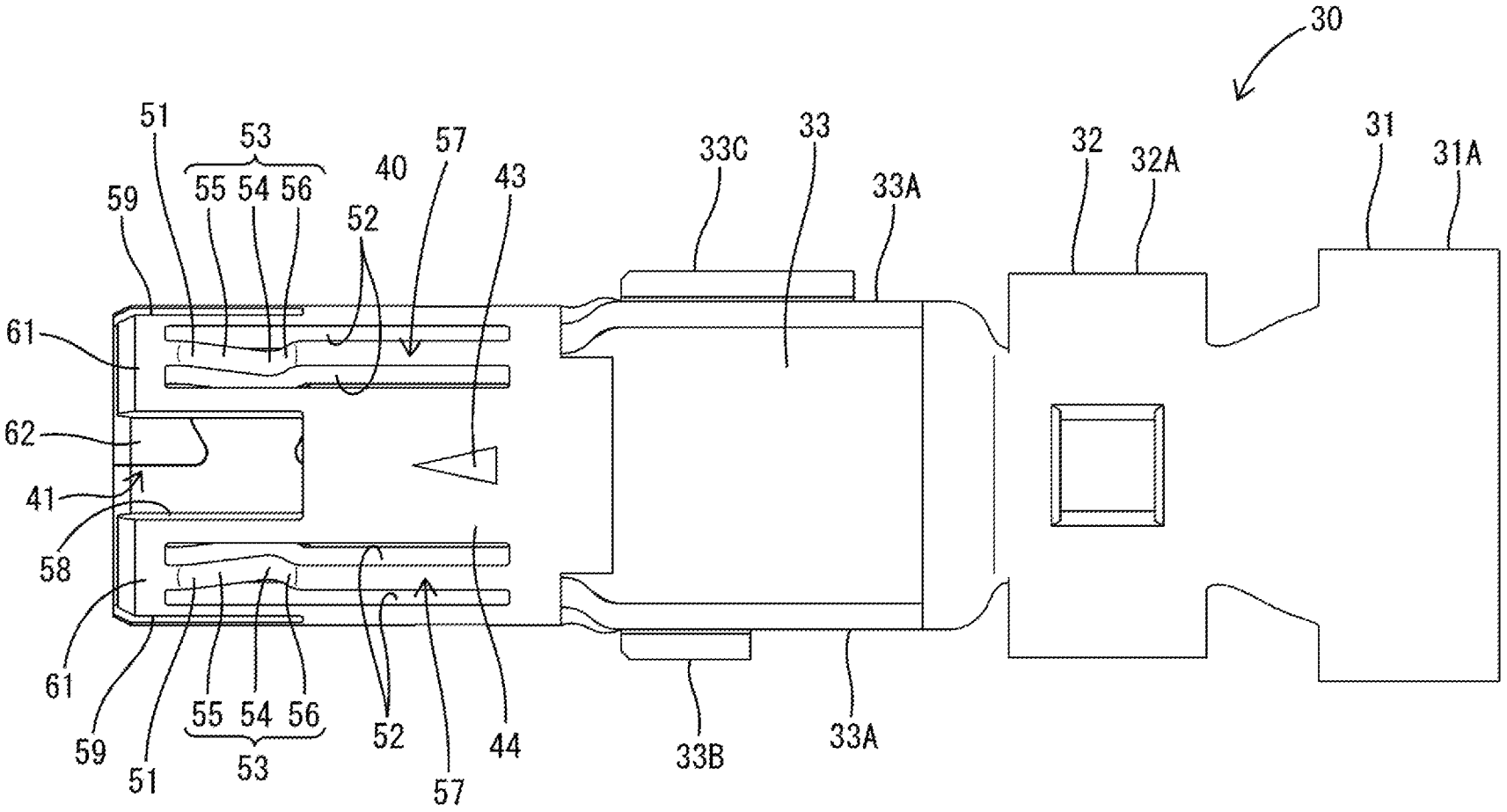
FIG. 9 is a bottom view of the outer conductor terminal.

As shown in FIGS. 5, 6 and 9, the resilient contacts 51 are at positions respectively radially or diametrically facing the fixed contacts 42 of the tubular fitting 40 in the opposite-side half circumference portion C2. Each resilient contact 51 is formed via two cutouts 52 elongated in the front-rear direction and is formed by bending and raising a front part of a region between the two parallel cutouts 52 of the tubular fitting 40. Each resilient contact 51 is supported on both front and rear ends directly connected to the tubular fitting 40 and resiliently displaceable in a radial direction.

Figure 7:
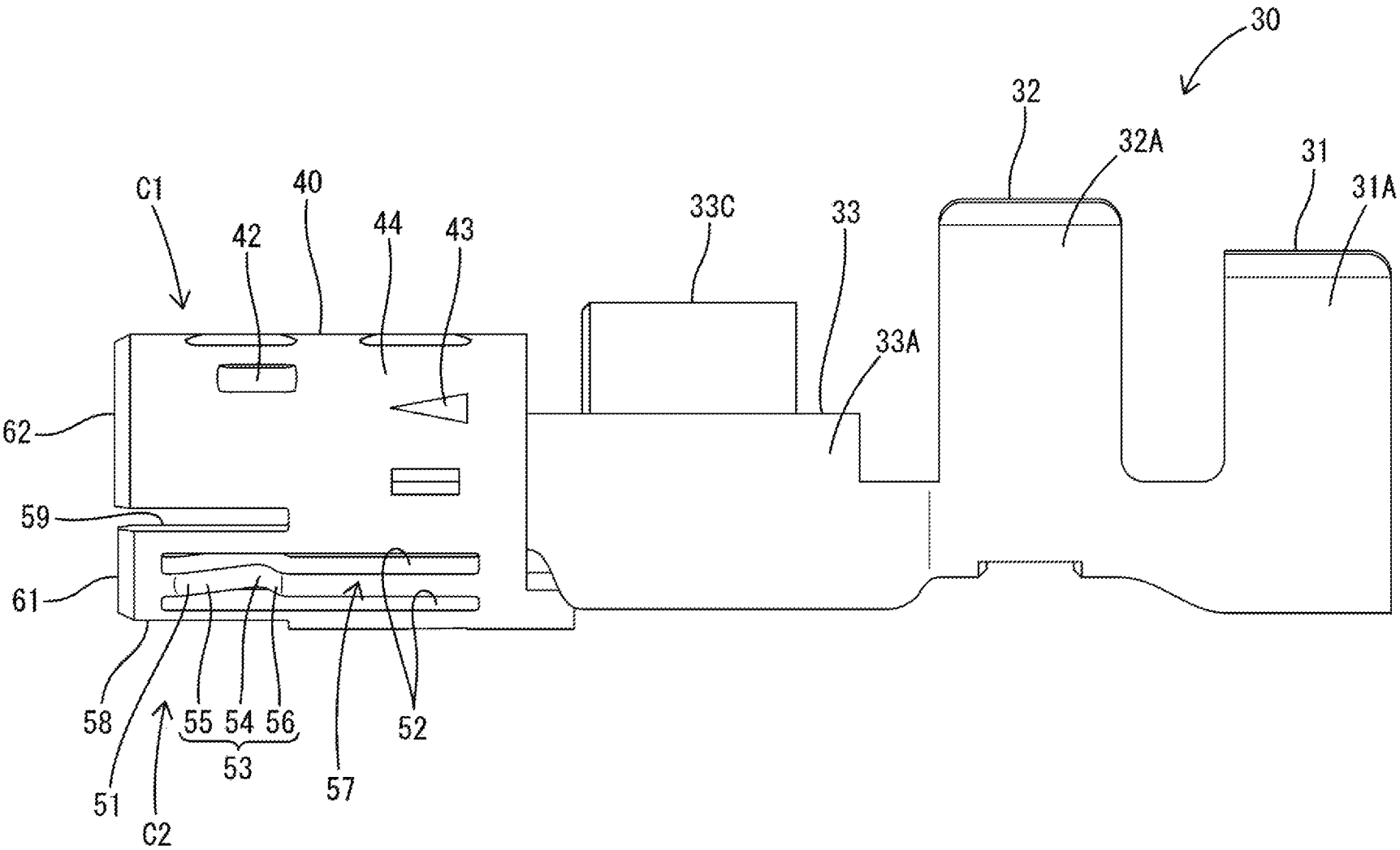
FIG. 7 is a side view of the outer conductor terminal.

As shown in FIGS. 5, 7 and 9, the resilient contact 51 is composed of a bent region 53 and a straight region 57. The bent region 53 constitutes a front part of the resilient contact 51. The straight region 57 constitutes a part of the resilient contact 51 behind the bent region 53. A dimension of the bent region 53 is shorter than that of the straight region 57 in the front-rear direction. The rear end of the bent region 53 is located forward of a center of the resilient contact 51 in the front-rear direction (length direction). When the resilient contact 51 is in a natural state without being resiliently deformed, the bent region 53 projects radially inwardly from the inner peripheral surface of the tubular fitting 40 and the straight region 57 extends straight in the front-rear direction.

As shown in FIGS. 5, 7 and 9, a part of the bent region 53 projecting most radially inward serves as a contact 54 configured to contact the outer periphery of the mating outer conductor 130 when the tubular fitting 40 is fit properly to the mating outer conductor 130. The contact 54 is located forward of the center of the resilient contact 51 in the front-rear direction (length direction of the resilient contact portion 51) and rearward of a center of the bent region 53 in the front-rear direction. The contacts 54 are at substantially the same position as the fixed contacts 42 in the front-rear direction.

A part of the bent region 53 between the front end of the resilient contact 51 (bent region 53) and the contact 54 forms a front inclined portion 55 inclined radially outward from the contact 54 toward the front end of the resilient contact 51, as shown in FIGS. 5, 7 and 9. In the process of fitting the outer conductor terminal 30 and the mating outer conductor 130, the tip edge of the mating outer conductor 130 slides in contact with the inner surfaces of the front inclined portions 55. By this sliding contact, a rearward pressing force and a radially outward pressing force act on the bent regions 53.

A part of the bent region 53 between the contact 54 and the rear end of the bent region 53 (front end of the straight region 57) forms a rear inclined portion 56 inclined radially outwardly from the contact point portion 54 toward the rear end of the resilient contact 51, as shown in FIGS. 5, 7 and 9. An angle of inclination of the rear inclined portion 56 with respect to the front-rear direction is smaller than that of the front inclined portion 55 with respect to the front-rear direction. A dimension of the rear inclined portion 56 is smaller than that of the front inclined portion 55 in the front-rear direction.

As shown in FIGS. 5, 6 and 9, the tubular fitting 40 includes an opening 58 formed by cutting off a part of a front end of a lower part (part between the pair of resilient contact portions 51). The opening 58 is open and extends from the tip of the tubular fitting 40 to the same position as the front ends of the straight regions 57 in the front-rear direction.

As shown in FIGS. 5 to 7, the tubular fitting 40 is formed with two slits 59 extending rearward from the front edge thereof. The slits 59 are formed at positions slightly above the upper cutouts 52 in the tubular fitting 40. The slits 59 have substantially the same length as the opening 58 in the front-rear direction.

As shown in FIGS. 5 and 6, a front part of the tubular fitting 40 is circumferentially divided into three regions including two bilaterally symmetrical and arcuate movable regions 61 in the opposite-side half circumference portion C2 and an arcuate immovable region 62 substantially immovable in the butting-side half circumference portion C1 by the opening 58 and the slits 59.

As shown in FIGS. 5, 7 and 9, the movable regions 61 are disposed to surround front end parts of the two resilient contacts 51 from the front and circumferentially (vertically). The front end of the resilient contact 51 is connected to the movable region 61. Further, a rear part of the movable region 61 is at a position overlapping the bent region 53 in the front-rear direction. Specifically, the rear end of the movable region 61 (i.e. rear end of the slit 59) is at the same position as the rear end of the rear inclined portion 56 in the front-rear direction. Note that the movable region 61 does not include the resilient contact 51.

As shown in FIGS. 5 to 7, the movable region 61 is cantilevered forward at the front of the tubular fitting 40, and the front end of the resilient contact portion 51 is connected to the movable region 61. Thus, if the bent region 53 of the resilient contact 51 is deformed resiliently in the radial direction or an axial direction (front-rear direction) by receiving an external force in the radial or axial direction, the movable region 61 is resiliently deformable in the radial direction with the rear end thereof as a fulcrum.

A tubular body 44 is defined on the tubular fitting 40 behind the movable regions 61 and the immovable region 62, as shown in FIGS. 5 and 7 to 9. The tubular body 44 has a hollow cylindrical shape continuous over substantially the entire circumference. Thus, even if the movable regions 61 are deformed resiliently in the radial direction, the tubular body 44 is not deformed significantly. The rear ends of the resilient contact pieces 51 are connected to the tubular body 44. Further, since the immovable region 62 is not connected directly to the resilient contact pieces 51, the immovable region 62 is not deformed significantly even if the movable regions 61 are deformed resiliently.

As shown in FIGS. 5 and 6, the tubular fitting 40 includes three inner locking portions 43 to be locked to the dielectric 23 on a rear end side. The three inner locking portions 43 are disposed at equal intervals along the circumferential direction of the tubular fitting 40. The inner locking portions 43 are formed by bending and raising side wall parts of the tubular fitting portion 40 inwardly via slits and form substantially triangular claws in a side view. The dielectric 23 is held in the tubular fitting 40 by being inserted into the tubular fitting 40 and locked by the inner locking portions 43.

The shield terminals 20 are mounted into the connector housing 80 by being inserted into the cavities 81 from behind without a retainer 85 being fit in the retainer fitting groove 82. As shown in FIG. 4, the extending pieces 33B are locked (primarily locked) by the locking lances 83 by riding over the locking lances 83 from behind. Then, as shown in FIG. 4, the retainer 85 secondarily locks the extending pieces 33C of the shield terminals 20 to restrict rearward movements by being fit into the retainer fitting groove 82. In this way, the shield terminals 20 are accommodated in a proper insertion posture in the connector housing 80.

Figure 10:
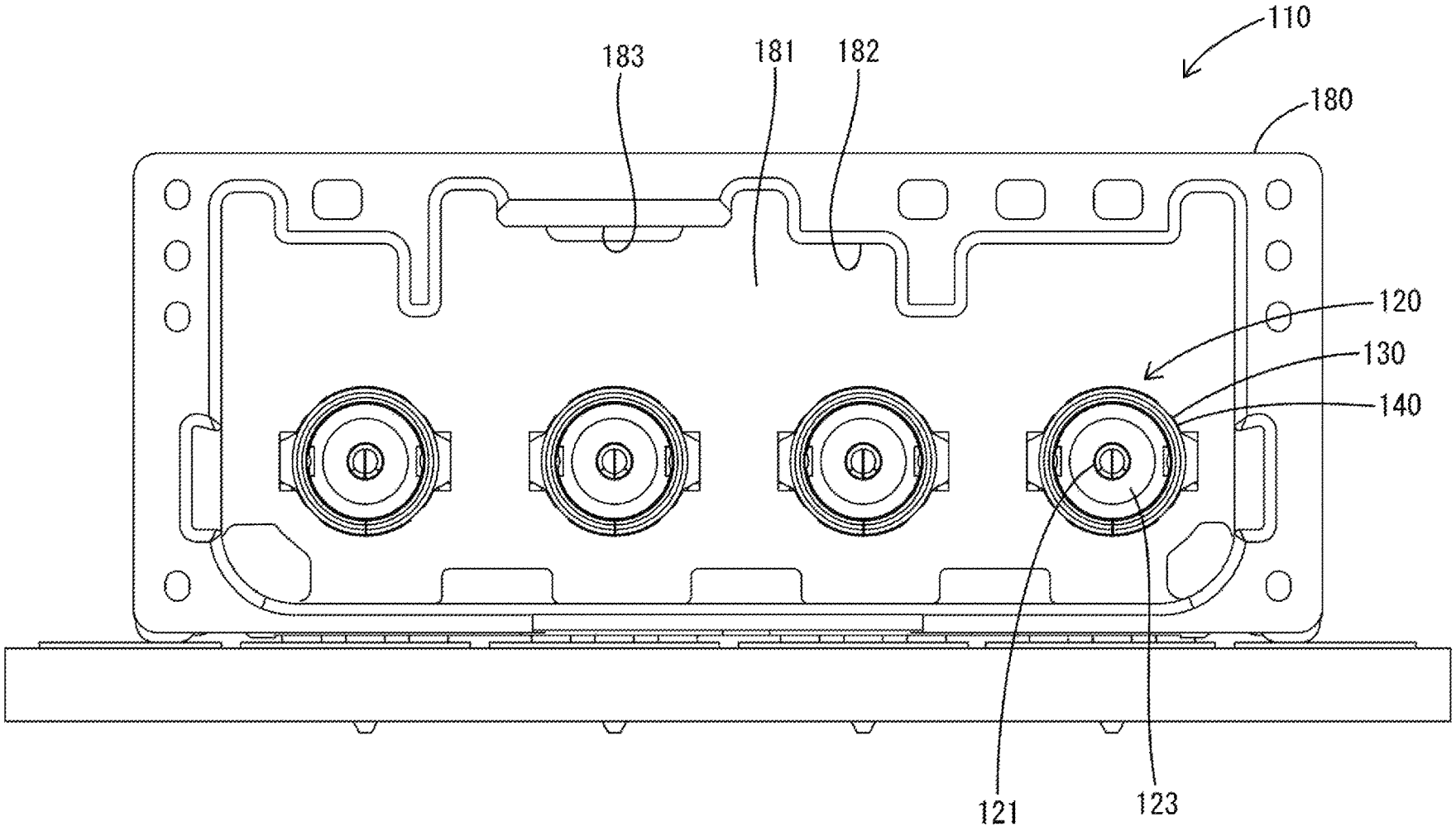
FIG. 10 is a front view of a mating connector.

As shown in FIG. 10, the mating connector 110 includes mating shield terminals 120 and the mating housing 180 for accommodating the mating shield terminals 120. The mating housing 180 is made of synthetic resin and includes a base wall 181 having a wall thickness direction extending in the front-rear direction and a wide rectangular tubular receptacle 182 projecting forward from the outer periphery of the base wall 181. The receptacle 182 includes the housing lock 183 on the inner surface of an upper wall, and the shield connector 10 is fit into the receptacle 182. The housing lock 183 locks the shield connector 10 to hold the connectors in a connected state. The mating shield terminals 120 are held through the base wall 181.

As shown in FIG. 10, the mating shield terminal 120 includes a mating inner conductor 121, the mating outer conductor 130 surrounding the outer periphery of the mating inner conductor 121 and a mating dielectric 123 interposed between the mating outer conductor 130 and the mating inner conductor 121. The mating outer conductor 130 includes a hollow cylindrical mating tubular portion 140 having an axis extending in the front-rear direction.

Next, functions of this embodiment are described.

Figure 11:
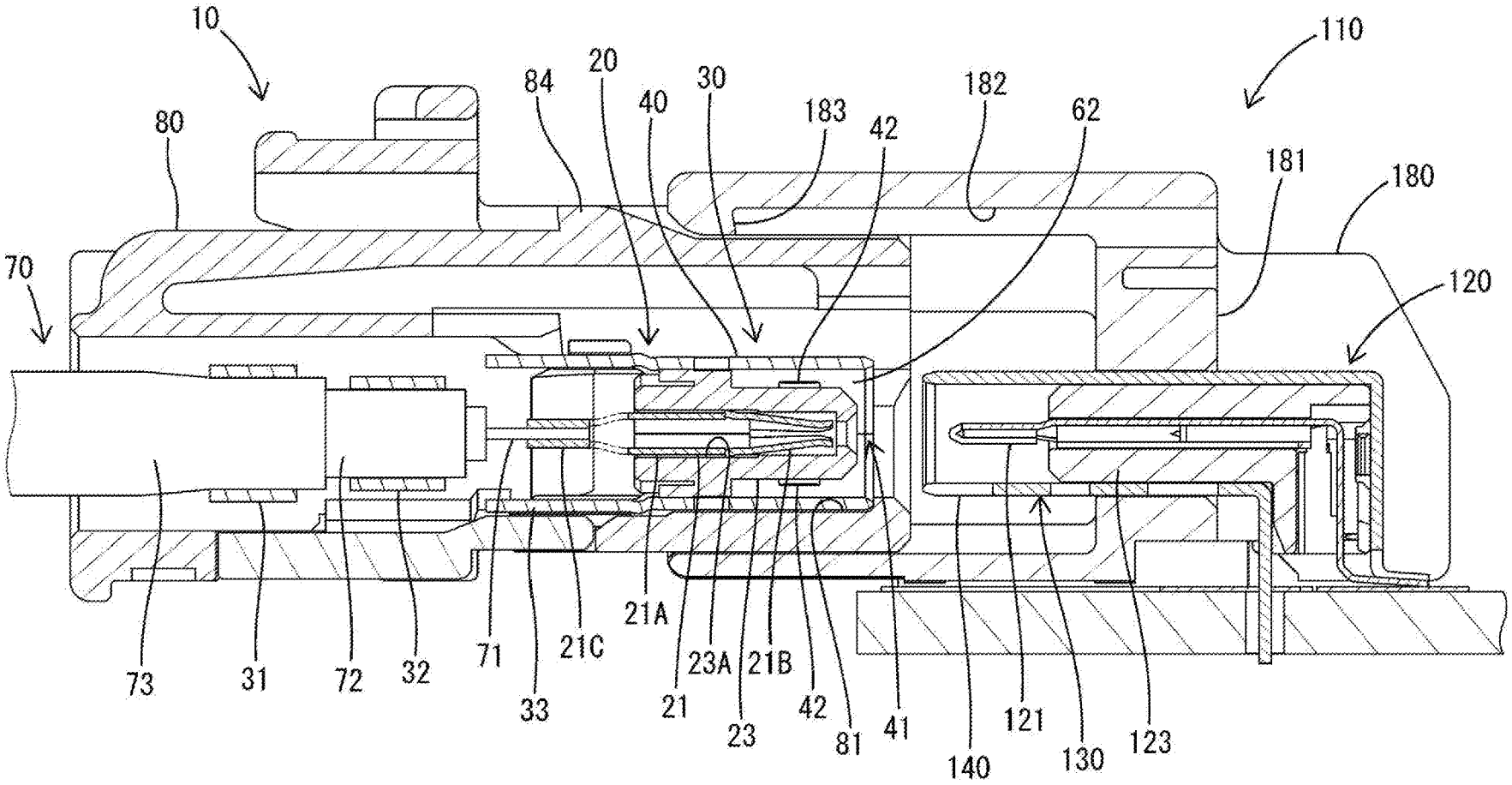
FIG. 11 is a side view in section showing a state while the shield connector and the mating connector are being connected.
Figure 12:
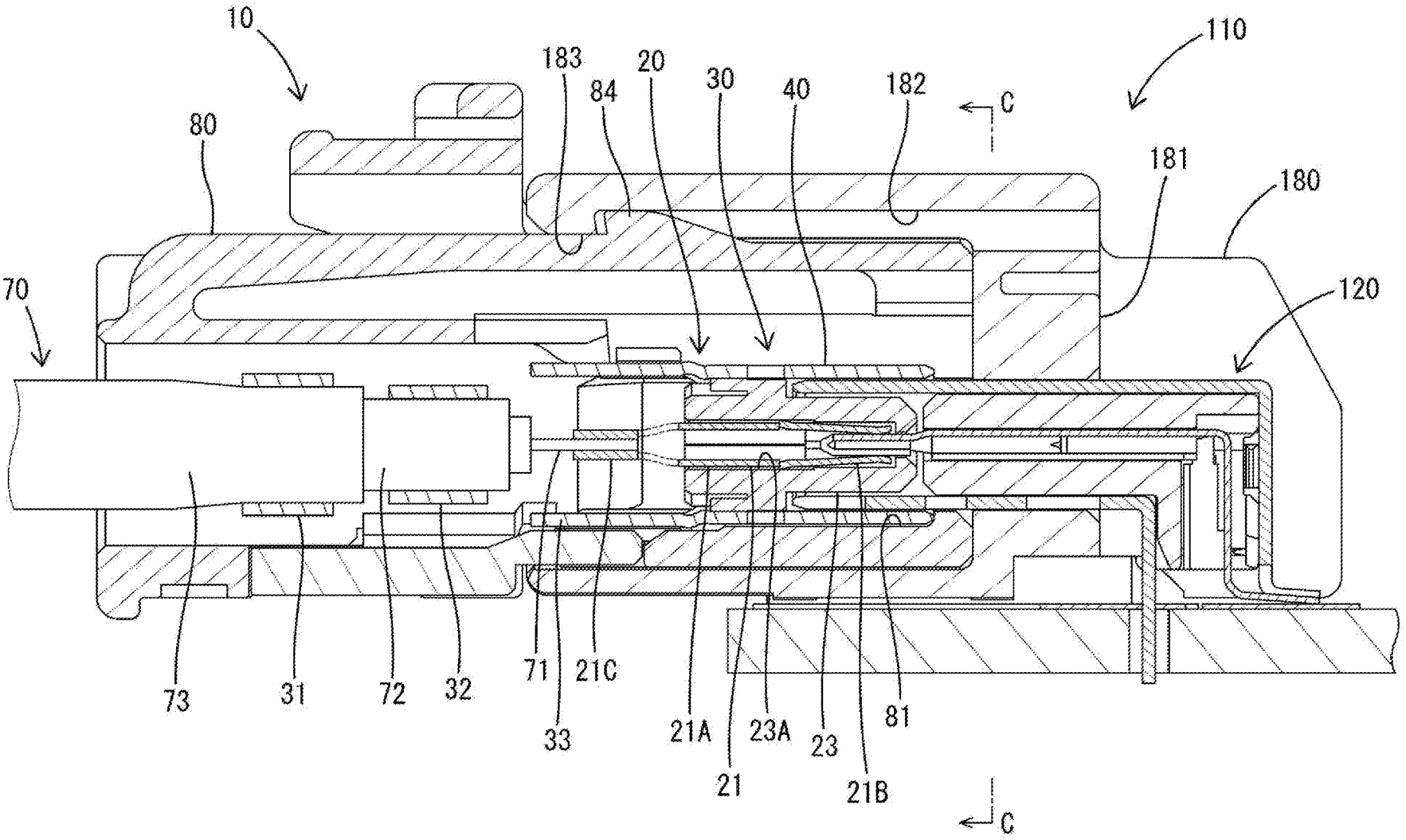
FIG. 12 is a side view in section showing a connected state of the shield connector and the mating connector.

The shield connector 10 and the mating connector 110 are connected by inserting a tip side of the connector housing 80 into the receptacle 182 of the mating housing 180, as shown in FIG. 11. When the connector housing 80 enters the receptacle 182, the housing lock 183 rides over the lock protrusion 84, as shown in FIG. 12. The housing lock 183 is locked to the lock protrusion 84 to hold the connector housing 80 in a locked state in the mating housing 180.

In the connected state of the connector housing 80 and the mating housing 180, the mating outer conductor 130 is fit in a clearance between the outer periphery of the dielectric 23 and the inner periphery of the tubular fitting 40, as shown in FIG. 12. In the process of connecting the connector housing 80 to the mating housing 180, the resilient contact pieces 51 (more specifically, front inclined portions 55 and contact point portions 54) contact the tip edge of the mating outer conductor 130 and receive rearward (leftward in FIGS. 11 and 12) and radially outward pressing forces. In this way, the bent regions 53 resiliently displace radially outward. As the bent regions 53 displace resiliently, the straight regions 57 deform resiliently to incline radially outward with the rear ends thereof as fulcrums, and the movable regions 61 resiliently deform to inclined radially inward with the rear ends thereof as fulcrums.

Figure 13:
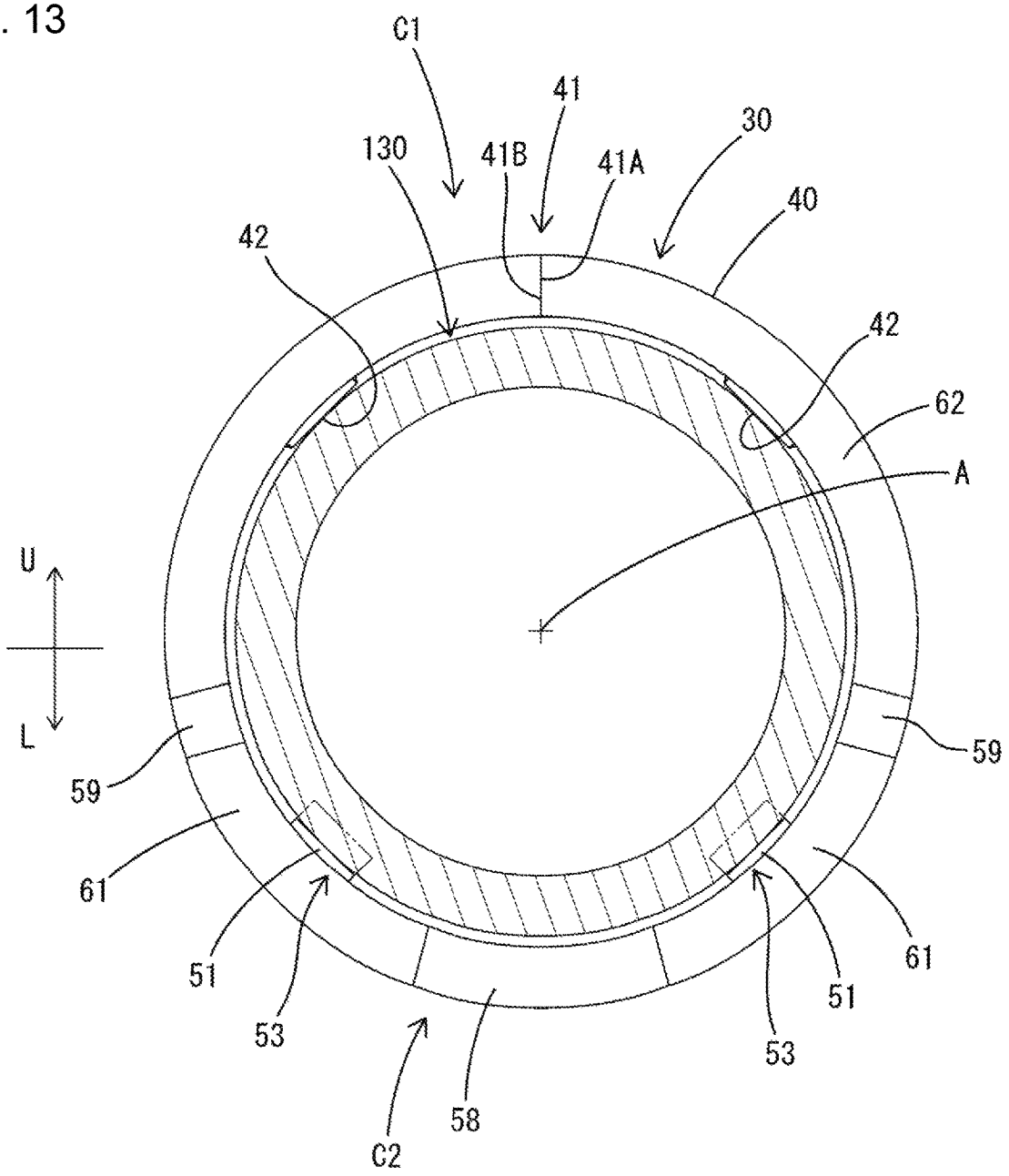
FIG. 13 is a section schematically showing a cross-section along C-C of FIG. 12.

When the mating outer conductor 130 is fit into the clearance between the outer periphery of the dielectric 23 and the inner periphery of the tubular fitting 40, the resilient contacts 51 and the two fixed contacts 42 contact the outer periphery of the mating outer conductor 130, as shown in FIG. 13. Note that only the tubular fitting 40 of the outer conductor terminal 30 and the mating tubular portion 140 of the mating outer conductor 130 are shown in FIG. 13 for the sake of convenience. The two resilient contact pieces 51 resiliently deform radially outward (deformed from a two-dot chain line shape to a solid line shape shown in FIG. 13) and contact the outer periphery of the mating outer conductor 130 while applying resilient forces. In this way, the outer conductor terminal 30 is connected conductively to the mating outer conductor 130 with a predetermined contact pressure via the resilient contact pieces 51 and the fixed contact point portions 42. On the other hand, the two fixed contacts 42 are not deformed. The mating tubular portion 140 is held in the tubular fitting 40 so that a center line (on an axis A of FIG. 13) is coaxially located on a center axis of the tubular fitting 40.

A return current corresponding to an electrical signal transmitted by the inner conductor terminal 21 is generated in the outer conductor terminal 30. Such a return current can be caused to flow to the mating outer conductor 130 via the resilient contact pieces 51 and the fixed contacts 42. Since the outer conductor terminal 30 is in contact with the mating outer conductor 130 on four points, the number of flowing paths of the return current increases and a shielding property can be improved as compared to a configuration in which one resilient contact piece and one fixed contact point portion are provided.

As shown in FIG. 13, the two resilient contacts 51 are formed at the positions respectively radially or diametrically facing the fixed contacts 42 of the tubular fitting 40 in the opposite-side half circumference portion C2. Specifically, the two resilient contacts 51 and the two fixed contacts 42 are disposed substantially at equal intervals along the circumferential direction. In this way, the resilient contacts 51 and the fixed contacts 42 can be arranged while being spaced apart a large distance in the circumferential direction of the tubular fitting portion 40. Thus, a return current can be caused to flow efficiently from the outer conductor terminal 30 to the mating outer conductor 130 and the shielding property can be improved.

As described above, the resilient contacts 51 and the fixed contacts 42 contact the mating outer conductor 130 with the mating outer conductor 130 fit in the tubular fitting 40. Thus, a return current generated in the outer conductor terminal 30 when an electrical signal flows in the inner conductor terminal 21 can be caused to flow to the mating outer conductor 130 via the resilient contacts 51 and the fixed contacts 42. In addition, the butting-side half circumference portion C1 where the embossed fixed contacts 42 are located can be formed without making any hole. Thus, as compared to a configuration in which contacts are formed with holes by cutting and raising, a strength around the butting edges 41 in the tubular fitting portion 40 is not reduced. In this way, it is possible to prevent the separation of the edge parts 41A, 41B in the circumferential direction of the tubular fitting 40 due to the lack of strength and prevent the deterioration of the shielding property for the inner conductor terminal 21 by the outer conductor terminal 30.

Other embodiments are briefly described below.

Although the resilient contacts 51 project toward an inner peripheral side in the above embodiment, the resilient contacts 51 may project toward an outer peripheral side if the mating outer conductor is externally fit.

Although the immovable region 62 adjacent to the movable regions 61 in the circumferential direction via the slits 59 is formed in the tubular fitting 40 in the above embodiment, the immovable region 62 may not be provided and only the movable regions 61 may be cantilevered forward.

Although the movable regions 61 are deformed resiliently to displace front ends thereof radially inward in the above embodiment, the movable regions 61 may be deformed resiliently to displace the front ends thereof radially outwardly.

Although one resilient contact portion 51 is formed in one movable region 61 in the above embodiment, plural resilient contact portions 51 may be formed in one movable region 61.

Although the outer conductor terminal 30 is formed with two fixed contacts 42 in the above embodiment, one, three or more fixed contacts 42 may be formed.

Although the rear ends of the slits 59 are disposed at the same position as the rear ends of the rear inclined portions 56 in the front-rear direction in the above embodiment, the rear ends of the slits 59 may be in front of or behind the rear ends of the rear inclined portions 56.

LIST OF REFERENCE SIGNS

10 . . . shield connector
20 . . . shield terminal
21 . . . inner conductor terminal
23 . . . dielectric
30 . . . outer conductor terminal
40 . . . tubular fitting
41 . . . butting edge
41A, 41B . . . edge part
42 . . . fixed contact
51 . . . resilient contact
80 . . . connector housing
130 . . . mating outer conductor
C1 . . . butting-side half circumference portion
C2 . . . opposite-side half circumference portion

What is claimed is:

1. A shield terminal, comprising:

an inner conductor terminal; and an outer conductor terminal surrounding the inner conductor terminal, the outer conductor terminal including a tubular fitting to which a mating outer conductor is fit, wherein the tubular fitting includes:

butting edges to be butted against each other on both circumferential edges;

a fixed contact formed to have an embossed shape in a butting-side half circumference portion where the butting edges are located, the fixed contact contacting the mating outer conductor; and a resilient contact formed by cutting and raising a part of an opposite-side half circumference portion on a side opposite to the butting-side half circumference portion, the resilient contact resiliently contacting the mating outer conductor.

2. The shield terminal of claim 1, wherein the tubular fitting includes two of the resilient contacts and two of the fixed contacts.

3. The shield terminal of claim 2, wherein:

the fixed contacts are formed respectively on both circumferential sides of the butting edges, and the resilient contacts are formed at positions respectively radially facing the fixed contacts in the tubular fitting.

4. A shield connector, comprising:

the shield terminal of claim 1;

a dielectric interposed between the inner conductor terminal and the outer conductor; and a connector housing accommodating the shield terminal.

* * * * *